United States Patent [19]

Beltz et al.

[11] Patent Number: 4,466,852

[45] Date of Patent: Aug. 21, 1984

[54] METHOD AND APPARATUS FOR DEMOUNTING WAFERS

[75] Inventors: Richard K. Beltz, Hamburg; Donald M. Large, Temple; Daniel D. Leffel, Pottstown, all of Pa.

[73] Assignee: AT&T Technologies, Inc., New York, N.Y.

[21] Appl. No.: 546,215

[22] Filed: Oct. 27, 1983

[51] Int. Cl.[3] ..... B32B 31/16

[52] U.S. Cl. ..... 156/344; 15/405; 29/426.4; 134/59; 156/584

[58] Field of Search ..... 15/316 R, 317, 405; 29/426.1, 426.4; 134/59; 156/344, 584, 155; 269/903

[56] References Cited

U.S. PATENT DOCUMENTS

| | | | |
|---|---|---|---|
| 2,517,193 | 8/1950 | Fraser | 51/53 |
| 3,436,789 | 4/1969 | Hays | 15/405 X |
| 3,850,721 | 11/1974 | Schubert | 156/155 |
| 3,915,784 | 10/1975 | Makhijani et al. | 156/344 |
| 3,992,236 | 11/1976 | Wanesky | 156/344 X |
| 4,104,099 | 8/1978 | Scherrer | 156/155 |
| 4,239,567 | 12/1980 | Winings | 156/344 X |
| 4,283,242 | 8/1981 | Regler et al. | 156/344 X |
| 4,334,945 | 6/1982 | Raush | 156/344 |

*Primary Examiner*—Robert A. Dawson
*Attorney, Agent, or Firm*—D. C. Watson

[57] ABSTRACT

Wafers (12), including those in the solid state electronics industry, are demounted from an adherent surface (79). A respective passageway (90) is extended from a fluid supply device (92), through the adherent surface (79) to and in communication with, the mounting surface (16) of a respective wafer (12). The fluid is applied via the passageway (90) to and between the mounting surface (16) of the wafer (12) and the adherent surface (79) with sufficient pressure to dislodge the wafer (12). In an advantageous embodiment, the passageway (90) extends to a location between about the centerline (98) and the periphery of the wafer (12). The fluid is thereby applied in an off-center manner with leveraged force to break the seal between the adherent surface (79) and the wafer (12).

15 Claims, 9 Drawing Figures

METHOD AND APPARATUS FOR DEMOUNTING WAFERS

TECHNICAL FIELD

This invention relates to demounting wafers which are adhered to surfaces. More particularly, the invention relates to demounting wafers which are tightly adhered to surfaces by a combination of forces in polishing and the properties of adherent surfaces and of the wafers.

BACKGROUND OF THE INVENTION

Wafers of glass, crystals, gem stones and other materials are pervasively polished in industry to obtain highly reflective surfaces. In the solid state electronics industry, such wafers typically include group III, IV and V materials in thin, usually disc-like shapes. Such wafers have an active side which is highly polished to facilitate formation of devices therein.

Apparatus for polishing such wafers include a carrier plate to which wafers are adhered with exposed surfaces downward upon, and in forced engagement with, a polishing pad on a platen. The platen and carrier are typically rotated at different velocities and/or directions causing relative lateral motion between the wafer surfaces and the pad. A slurry containing abrasive compounds, chemicals and water is provided at the pad/-wafer interface to aid in the polishing process.

Wafers have been mounted to carriers by many methods in the past with varying degrees of success. For example, mechanical means were utilized such as wax mounts, mechanical cups, pin restraints and vacuum devices which were costly and their use untidy and time consuming. Much effort has been expended to develop for carriers, mounting pads which would facilitate free mounting of wafers, i.e., pads which would develop enough adherency due to friction, liquid tension, suction or similar phenomena to hold wafers freely on a pad without mechanical restraints.

Although mechanical restraints are still utilized for some applications, a large portion of wafer polishing is now accomplished by free mounting, employing a composite pad. The pad typically includes a relatively firm outer layer and a compressible layer including a fiber matrix for cementing to a carrier. The outer layer provides a mounting surface which is wetted and sometimes treated with a chemical to promote adhesion. The wafers are thoroughly cleaned and their mounting surfaces are sometimes treated to promote adhesion. Consequently, the condition of pad surfaces and wafers combine with polishing forces to seat the wafers so firmly on a carrier that they are difficult to demount without breakage. Such breakage is particularly evident in demounting large wafers or polysilicon wafers having formed therein a pattern of monocrystalline sites surrounded by oxide layers.

In the known methods of demounting wafers, a carrier is removed from a polisher and inverted at a workbench or sink. Typically, a tool such as a knife blade or a tweezer is utilized at an edge to pry a wafer from a pad surface. Sometimes a vacuum pickup tool is applied to the exposed face of the wafer to assist in demounting. These and similar mechanical methods involve an ever present risk of injury, whereby a small percentage of wafers are broken or have edges badly chipped.

Other prior art methods of handling wafers include thermal manipulations to expand and contact mounting pads. For example, heat and pressure are sometimes utilized to seat wafers to pads and chilling is utilized to break the seals. In another demounting method, a carrier is inverted in a sink and a pulsating water jet is applied at the edge of each wafer until it is dislodged and removed. The thermal manipulation method is costly in time and equipment. The water jet method reduces breakage but has not been readily accepted because the demounting time varies depending upon the bond between an adherent surface and a wafer and back spray sometimes strikes clothing and eyeshields, causing annoyance to operators.

Accordingly, it is desirable to provide new and improved expedients for demounting wafers. Such demounting should be done at least as economically and expeditiously as was done in the prior art, but without previous injury to wafers and annoyance to operators. It is particularly desirable to demount wafers without removing carriers from polishing machines. Such demounting should be amenable to large wafers and polysilicon wafers having complex, fragile structures.

SUMMARY OF THE INVENTION

Expedients are provided to demount a wafer from an adherent surface such as that upon which wafers are free mounted for polishing. A passageway is extended from a fluid supply device, through the adherent surface to and in communication with a mounting surface of the wafer. The fluid is applied via the passageway to and between the mounting surface of the wafer and the adherent surface with sufficient pressure to dislodge the wafer from the adherent surface.

In another embodiment, the adherent surface is provided on a suitable compressible pad. The passageway is extended through the pad to the mounting surface of the wafer.

In another embodiment, the passageway extends through the adherent surface at a location off-center of a wafer. Consequently, fluid is applied to the mounting surface of the wafer in a leveraged manner.

BRIEF DESCRIPTION OF THE DRAWING

The invention will be more readily understood from the following detailed description when read in conjunction with the drawing wherein.

Figure 1:
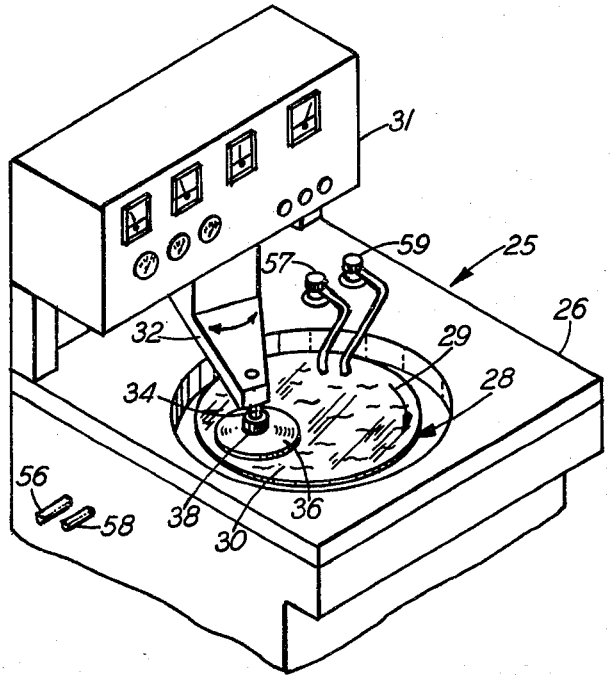
FIG. 1 is a pictorial view of a typical polishing machine including a carrier from which wafers may be demounted in accordance with the invention.

Some of the elements in the figures are abbreviated or simplified to highlight features of the invention. Also, where appropriate, reference numerals have been repeated in the figures to designate the same or corresponding features in the drawing.

DETAILED DESCRIPTION

The Wafers

Wafers are generally perceived to be relatively thin articles having two major surfaces which are substantially planar and parallel to each other. In the solid state electronics industry, wafers have the generally accepted description given above and are usually derived by transversely sawing slices from crystalline ingots. Such ingots are grown from germanium, silicon, garnet, gallium arsenide, indium phosphide and a host of other materials, typically having elements found in groups III, IV and V of the Periodic Table. When the ingots are grown by the well-known Czochralski method, they have a generally cylindrical body and often a flat portion extending longitudinally of the body. Consequently, when wafers are cut from such a crystalline body they appear disc-like in shape with a segment omitted along a chord, often called a "flat." Representative wafers or portions thereof are depicted in FIGS. 2–9, designated generally by the numeral 12. A wafer 12 typically has a front, active side 14 and a rear, inactive side 16 which will also be referred to in a polishing context as a mounting surface 16. A typical flat 18 is seen on the wafers 12 shown in FIG. 2.

In the processing of such wafers 12, additional layers such as oxides, nitrides and monocrystalline materials may be grown thereon. Polycrystalline materials, typically amorphous, may also be deposited. Heretofore, such layers did not typically affect the strength of a wafer, at least in a polishing operation.

Figure 3:
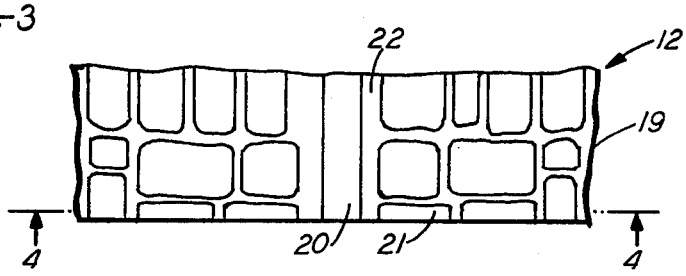
FIG. 3 is a plan view of a portion of a wafer containing various sites of materials formed in a different substrate material.
Figure 4:
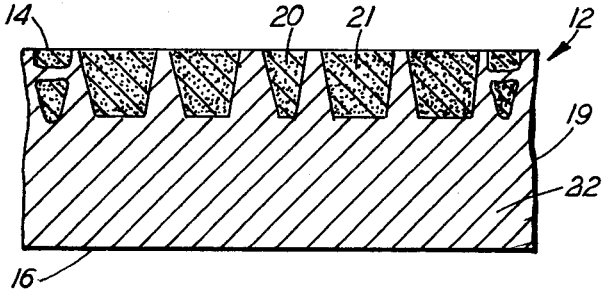
FIG. 4 is a sectional view of the wafer portion shown in FIG. 3, taken along line 4—4.

However, high voltage switches are now being manufactured from silicon wafers which have a complex, composite structure. FIG. 3 is a plan view of a portion 19 of a wafer 12 showing sites 20 and 21 of monocrystalline silicon surrounded by a supporting structure 22 of polycrystalline silicon. FIG. 4 is a cross-section view of portion 19 taken along line 4—4 which shows the depth and shape of sites 20 and 21 to explain why such sites are also called tubs 20 and 21. Although, not clearly shown because of the small scale, each tub 20 and 21 is surrounded laterally by a thick oxide coating which acts as a dielectric barrier to isolate a tub, hence the term dielectric-isolated, or "D.I.", wafers. It will be appreciated from the material differences and structure of D.I. wafers that they are more fragile than wafers formed of monocrystalline silicon. The polysilicon structure 22 has a weakened resistance to chipping, splitting and puncture. Consequently, D.I. wafers are more difficult than monocrystalline solid state wafers to process through physically stressful operations.

D.I. wafers which are currently being processed are up to about four inches in diameter. Other solid state wafers range up to about six inches in diameter. It will be appreciated that the larger and more complex wafers are not only more risky to handle but also involve greater financial loss when damage is sustained.

Polishing Wafers

Wafers may be prepared to a thickness ranging from about 0.15 inch to about 0.030 inch or more, depending upon the particular technology involved. Raw slices are often lapped by other means on both sides to achieve substantially parallel surfaces and the inactive sides are sometimes ground to obtain good mounting surfaces. Such slices may then be polished to provide starting wafers or wafers which have received significant processing may be submitted for polishing. The purpose of polishing is to remove nicks, grooves and similar scars not previously removed or which have been sustained from prior operations. Such scars inhibit photolithographic work where features down to about two microns or less in size may be important.

FIG. 1 depicts a typical polishing machine 25 of the type sold by R. Howard Strasbaugh Inc., of Long Beach, Calif. A base 26 supports a rotatable turntable referred to as a platen 28 which is driven by a motor (not shown), typically in a clockwise direction according to arrow 29. A polishing pad 30 covers and is bonded to a flat, top surface of platen 28. An overhead control structure 31 supports and oscillates an arm 32 horizontally across platen 28. Arm 32 supports a vertical spindle 34 which in turn supports a wafer carrier 36 via a pivotal connector 38. Typically, in sequential polishing cycles, at least two carriers 36 are alternately utilized to facilitate mounting and demounting wafers away from machine 25.

Figure 2:
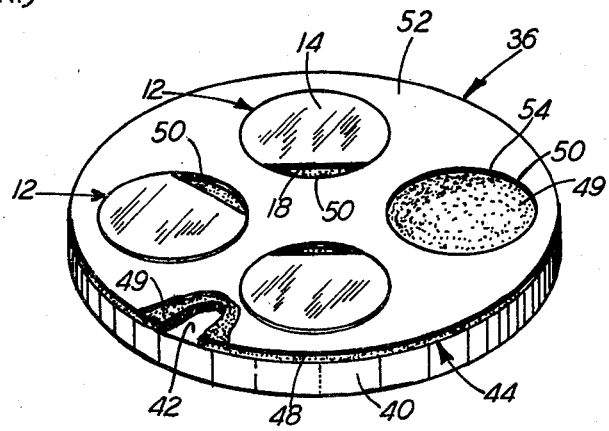
FIG.-2 (PRIOR ART)
FIG. 2 is a pictorial view of a carrier removed from the machine shown in FIG. 1 and inverted to illustrate a prior art expedient for mounting wafers.

FIG. 2 shows a prior art carrier 36 which is removed from a machine 25 and inverted for free mounting wafers 12. Carrier 36 includes a thick metal plate 40 having a machined, planar surface 42 to which a mounting pad 44 is bonded. Pad 44 preferably includes a base matrix of fibers held together by a microcellular polyurethane surface layer 48. An outer surface 49 is smooth and the microcellular nature of layer 48 accommodates imperfections on the mounting surfaces of wafers 12 to provide uniform support.

The surface 49 may be treated by many techniques to make it adherent to wafers 12. For example, good adherency is obtained merely by cleaning and wetting the surface 49 with water. Another technique is to treat surface 49 with acetic acid, as disclosed in one embodiment of an invention in U.S. Pat. No. 4,239,567 assigned to the assignee of this application. After the surface 49 is thoroughly wetted, all excess moisture is generally removed from the surface, by scraping which further activates and makes it more adherent to wafers 12.

Wafers 12 are prepared by thoroughly cleaning the rear, mounting surfaces to remove dirt and sometime oxide coatings. The wafers 12 are nearly always degreased by treatment with detergents or solvents. Often oxides and similar coatings are removed by mild etchants which may include hydrofluoric acid. Sometimes such an etchant is purposely utilized to render the mounting surfaces 16 hydrophobic which is seen to measurably increase an expected bond between the adherent surface 49 on a carrier 36 and the mounting surfaces 16 of wafers 12.

FIG. 2 also shows a plurality of pockets 50 to readily locate a corresponding plurality of wafers 12 for polishing. Pockets 50 are formed from a sheet 52 of a thin, tough material such as fiber-reinforced plastic which will withstand corrosive effects of polishing chemicals. Sheet 52 is also referred to as a template 52 and it is cemented to surface 49 as shown. Template 52 also provides inside walls 54 which help to retain an errant wafer 12 should it break its bond with the adherent surface 49 and tend to slide off carrier 36.

After the wafers 12 are mounted to inverted carrier 36, the carrier is reverted and attached to spindle 34 of the machine 25 shown in FIG. 1. The carrier 36 is pressed downward against the surface of pad 30 and the platen 28 is rotated. When platen 28 rotates, the carrier 36 tends to rotate of its own accord and the temperature of the wafer/pad interface tends to rise significantly. Accordingly, a pipe 56 supplies water through valve 57 to control temperature and to clean surfaces between cycles. Another pipe 58 supplies, through a valve 59, a polishing slurry of any of a variety of types well known in the art. The pressure on carrier 36, the elevated temperature, the friction with pad 30, possible chemical reactions and other factors combine to seat the wafers 12 with a tight adherence to the surface 49 (FIG. 2) of the pad 44.

Demounting Wafers

Figure 5:
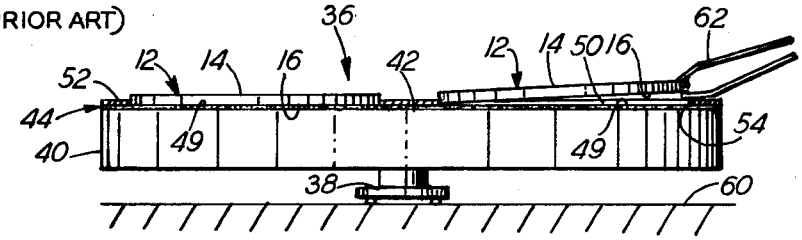
FIG.-5 (PRIOR ART)
FIGS. 5 and 6 are elevation type views of the removed and inverted carrier shown in FIG. 2 depicting prior art expedients for demounting wafers.

FIG. 5 illustrates a prior art method of demounting wafers 12 from a carrier 36. Note that carrier 36 has been disconnected at connector 38, removed from machine 25, inverted and placed upon a workbench surface 60, all of which are time consuming steps. Then a tool such as a tweezer 62 is applied at the peripheral edges of wafer 12 to pry the same from adherent surface 49. It will be appreciated that the mounting surface 16 tends to adhere to adherent surface 49. Often several attempts to several peripheral locations are made until adherence is broken and a wafer 12 may be removed from a pocket 50. Tool 62 sometimes gouges template 52, a wall 54, the surface 49 or a wafer 12. Chipping of edges sometimes occurs and at times a wafer 12 will break completely through and become at least two, somewhat worthless pieces. It is theorized that the wafers 12 develop unreleased stresses during polishing which release in a random and sometimes adverse manner during the mechanical demounting procedure depicted in FIG. 5.

Figure 6:
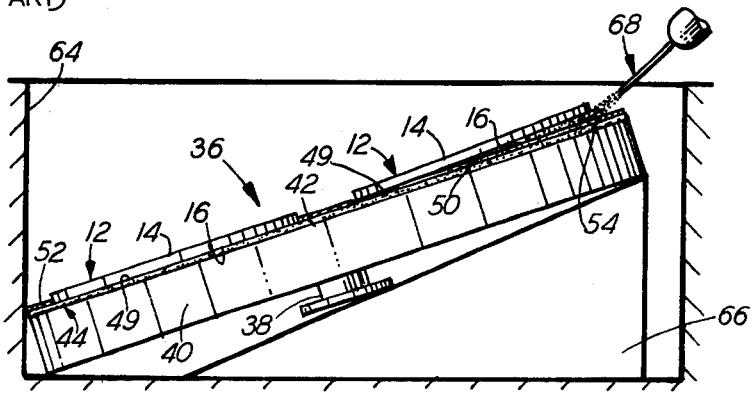
FIG.-6 (PRIOR ART)

FIG. 6 illustrates another prior art, hydraulic method of demounting wafers 12 from a carrier 36 which releases stresses and avoids many of the shortcomings of mechanical demounting. Note, however, that all of the preparatory, time, consuming steps mentioned above are also required in the hydraulic method. In addition, one places carrier 36 in a sink 64 and disposes the carrier in a sloping manner upon a support 66. Then a tool 68 which provides a pulsating jet of water is applied at the peripheral edges of a wafer 12 to hydraulically break the seal between adherent surface 49 and mounting surface 16 of a wafer 12. Often it takes an annoying length of time to break a seal and apply a sufficient amount of water within a pocket 50 to lift a wafer 12 so it may be grasped by one's fingers. Also, when the water floods a pocket 50, a dislodged wafer sometimes slides downward and upon a sink wall with sufficient force to break or chip a wafer 12. These and other problems have inhibited operator acceptance of tool 68 and this hydraulic method of demounting wafers 12.

Figure 8:
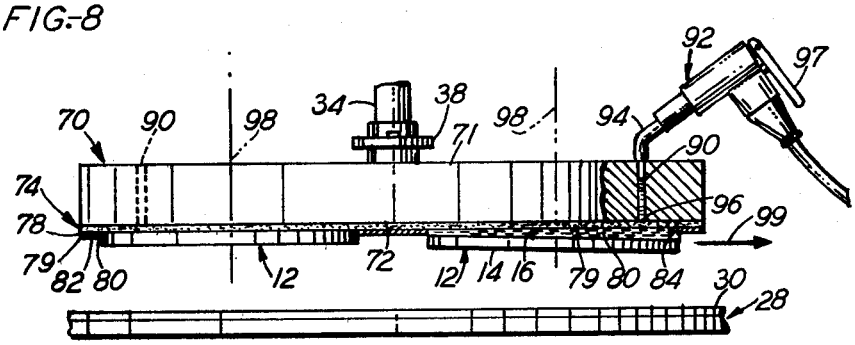
Figure 9:
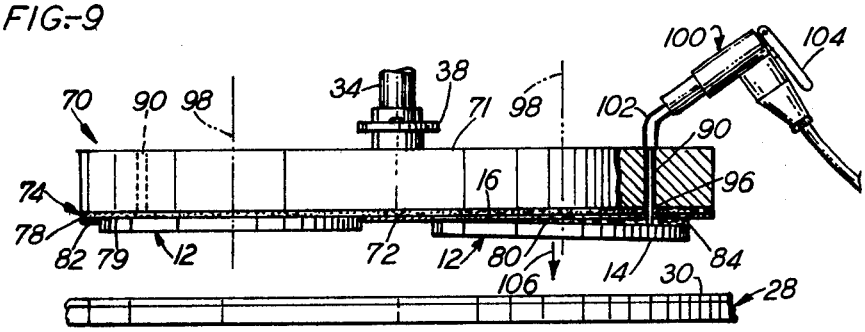

There has been found, a solution to the demounting problem which is perceived to be contra-indicated by teachings in the prior art. For example, it has been taught that irregularities in wafer seats are to be scrupulously avoided. Such irregularities cause stresses to be transferred to the active side of a wafer where marks such as dimples and waves appear in a polished surface. These teachings were especially evident in some prior vacuum mounting techniques utilizing vacuum ports in wafer seats. Sometimes the ports created indelible impressions which became permanently evident in marks on polished surfaces. Yet the demounting expedients of the present invention involve a deliberate use of at least one small port adjacent to the mounting side 16 of a wafer 12 as shown in FIGS. 7, 8 and 9.

Figure 7:
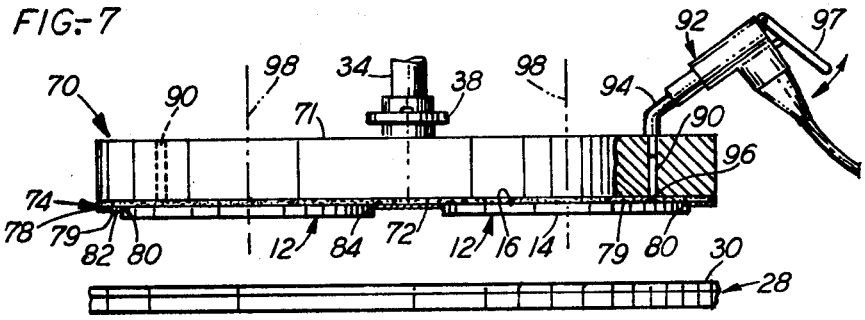
FIGS. 7, 8 and 9 are elevation type views of a carrier attached to a polishing spindle and expedients for demounting wafers according to various embodiments of the instant invention.

FIG. 7 illustrates a carrier region of a machine 25 wherein a novel carrier 70 is shown holding wafers 12 to be demounted. Carrier 70 includes a plate 71 having an underside 72, a pad 74 having a compressible layer 78 and an adherent surface 79, pockets 80 formed in a template 82 to stop errant wafers against inside walls 84 and a connector 38 whereby the carrier 70 is pivotally connected to spindle 34. All such items are similar in form and function to corresponding items described previously for carrier 36.

FIG. 7 depicts a step which occurs after polishing between the active sides 14 of wafers 12 and the pad 30 on platen 28 is completed. Carrier 70 is raised in the normal manner where, according to the prior art; the carrier would be disconnected, inverted, carried to a workbench or sink, and the wafers 12 would be demounted.

However, FIG. 7 discloses a passageway 90 having one end adjacent a fluid supply device 92 which may conveniently be a water spray gun similar to that utilized to spray dishes or vegetables. However, gun 92 is provided with a nozzle 94 which confines the fluid and permits injecting the same into passageway 90. A respective passageway 90 extends from a fluid supply device 92 through the underside 72 of plate 71, through compressible pad 74 and through the adherent surface 79 in a respective pocket 80. Each respective passageway 90 is thereby in communication with a mounting surface 16 of a respective wafer 12. By such communication it is meant that an exit port 96 from passageway 90 is adjacent and open to a mounting surface 16. Consequently, fluid entering passageway 90 will be directed to and flow over a surface 16 subject to any restrictions caused by a seal between such surface and surface 79 of pad 74.

The operation of the invention is depicted in FIG. 8 showing a trigger 97 of gun 92 in a depressed manner and fluid is applied under pressure into passageway 90. The fluid travels through port 96 to and between the mounting surface 16 of wafer 12 and the adherent surface 79 of the pad 74. It has been found that the size and fragility of the wafer 12, the type of fluid and available pressure, the position of port 96 and the working movements desired by an operator are among the factors to be considered in separate embodiments of the invention.

In a first example, the four inch diameter, D.I. wafers described previously were mounted and polished and the carrier 70 was elevated for demounting wafers 12. A water supply gun 92 was utilized and a passageway (not shown) was provided having its exit port at centerline 98. The gun 92 had a supply of water at 5 psig line pressure. When trigger 97 was actuated, the wafer 12 did not move. However, with subsequent applications of pressure by actuating trigger 97, the wafer 12 was dislodged and floated on a film of water from whence it was readily removed by an operator. It is believed that a higher pressure would have readily dislodged the wafer 12 in the initial attempt.

In a second example, the same type of wafer 12 was mounted and all other conditions were the same as the first example except that passageway 90 having an exit port 96 as shown in FIG. 8 was utilized. When trigger 97 was actuated, the wafer 12 immediately became dislodged and adhered to a film of water as shown in FIG. 8. Some operators seem pleased with this feature because the wafer 12 does not get away or fall with attendant risk of breakage. Wafer 12 is removed from carrier 70 by merely sliding the same away from pocket 80 according to arrow 99.

Note that exit port 96 is located between centerline 98 and the periphery of wafer pocket 80. The fluid is applied in an off-center manner which tends to leverage the demounting forces. Accordingly, the magnitude of pressure needed is much less than when a fluid exit port is at centerline 98. The closer the exit port is to the periphery of the wafer 12, the less pressure is required and the less total stress is exerted upon the sometimes fragile wafers.

In a third example, air was utilized as the fluid at a line pressure of about 35 psig. It was found that such pressure readily demounted wafers 12 but in some cases a D.I. wafer was so fragile that the air blew a hole through the wafer. However, by varying the air line pressure from about 5 psig to about 25 psig the demounting results were similar to that experienced in the second example.

Applications of water or air should be made at a pressure suitable to the polishing and seating conditions and to the size and type of wafer 12. For example, four inch diameter monocrystalline silicon wafers are stronger than D.I. wafers and can tolerate more pressure. Also, when polishing pressures and temperatures are high, the wafers 12 become very firmly seated and higher pressures may be indicated.

It was found that the wafers tend to cling to a film of moisture at, but not necessarily in, the pockets 80. When water is utilized, only a short spurt is required to demount a wafer 12. By such demounting it is meant that the mounting surface 16 of a wafer 12 is dislodged from its engagement with the adherent surface 79. When excess water is utilized, the water tends to bleed out at the walls 84 of the pockets 80, but a wafer 12 remains clinging to a film of moisture.

Even when air is utilized as the demounting fluid, the wafers tend to cling at or near the pockets 80, probably due to wetness which remains from the polishing process.

It is expected that elimination of template 82 and pockets 80 would cause the wafers 12 to demount differently. More of the wafers 12 may fall directly into an operator's hand and not cling to a film as shown in FIG. 8. Nevertheless, such free mounted wafers would be readily demounted in the practice of the invention.

Other embodiments of the invention are available for those operators who prefer to remove the wafers 12 without sliding them off a film. For example, if a wafer 12 is strong enough to resist higher forces, one need only increase the fluid pressure to gun 92 and the wafers 12 may be readily, downwardly disengaged from surface 79 and carrier 36.

Another embodiment is depicted in FIG. 9 with respect to the same carrier 70 and ancillary features, except for the fluid gun. A fluid gun 100 is shown having an extended nozzle 102. In operation of the embodiment, a trigger 104 is actuated whereby the fluid enters passageway 90 under pressure. The wafer 12 becomes dislodged as shown in FIG. 8 and the operator then pushes the extended nozzle 102 downward and against mounting surface 16 of wafer 12 as shown in FIG. 9. The wafer 12 becomes disengaged from carrier 70 and falls away according to arrow 106. An operator typically catches the wafer 12 manually and disposes the same in a receptacle although a water filled container may also be used and the wafer 16 could fall directly into the water.

Other Considerations

The practice of the invention in the various embodiments produced no deleterious marks on either the mounting surfaces 16 or the polished surfaces 14 of the wafers 12. It is believed that this surprising result is due to many factors. For example, in the prior art method of vacuum mounting wafers many ports were utilized and a strong vacuum was drawn through such ports. Here there is no vacuum drawn through port 96. Also, the seating surfaces provided in the prior art vacuum mounting did not include compressible pads like the composite polyurethane pads 44 or 74. It is believed that the combination of the pads 44 or 74, a relatively small (e.g. 0.187 inch diameter) port 96 and sufficient smooth surface 49 or 79 which is compressible and adjacent to port 96, help to avoid the previously noted deleterious marks.

Another advantage noted in the practice of applicants' invention is that carrier removal and other manipulation steps are eliminated which saves time and effort. Of course, operators may elect to remove a carrier for other functions after the wafers are demounted. But manipulation of wafers is minimized, with attendant risk of breakage.

Although the invention has been described with respect to solid state electronic device wafers, the invention is not so limited. It is believed that many other wafers of other materials may as well be demounted as described. Moreover, the invention is not limited to polishing wafers but could as well be utilized to demount wafers from adherent surfaces in other operations. Also, the definition of wafers is not limited to a particular shape. Other similar articles having no protruding features useful for grasping could as well be demounted in the practice of the invention.

There have been illustrated herein certain practical embodiments and applications of the invention. It is believed that one of ordinary skill in this art can, with little experimentation, adapt the teachings so other sizes and types of articles may be demounted. Such adaptations and refinements may be made without departing from the spirit and scope of the present invention.

What is claimed is:

1. A method of demounting a wafer from an adherent surface, comprising:

applying, via a passageway through the adherent surface, to and between the adherent surface and a mounting surface of the wafer, a fluid with sufficient pressure to dislodge the wafer; and removing the dislodged wafer from the adherent surface.

2. A method of demounting a wafer from an adherent surface, comprising:

extending a passageway from fluid supply means, through the adherent surface to and in communication with, a mounting surface of the wafer; and applying fluid via a passsageway through the adherent surface to and between the mounting surface of the wafer and the adherent surface with sufficient pressure to dislodge the wafer from the adherent surface.

3. A method as in claim 2 wherein the adherent surface is provided on a compressible pad on a wafer carrier further comprising:

extending the passageway through the pad to the mounting surface of the wafer.

4. A method as in claim 3 wherein the step of extending the passageway further includes:

extending the passageway through the adherent surface at a location between about the center and the periphery of the mounting surface of a wafer such that the fluid is initially applied off-center of the wafer.

5. A method as in claim 4 wherein the applying step further comprises:

applying a liquid with sufficient pressure to dislodge the wafer but with insufficient pressure to fully disengage the wafer from the carrier such that the wafer rides upon a liquid film on a surface and is readily removed therefrom.

6. A method as in claim 5 wherein the applying step further comprises:

applying the liquid with supply means including a nozzle which penetrates through the passageway a distance sufficient to push the wafer off the liquid film; and extending said nozzle through the passageway and against the wafer a distance sufficient to push the wafer off the liquid film and off the carrier.

7. A method as in claim 4 wherein the fluid applied via the passageway is water.

8. A method as in claim 4 wherein the fluid applied via the passageway is air.

9. Apparatus for demounting a wafer from an adherent surface comprising:

a passageway extending from fluid supply means, through the adherent surface to and in communication with a mounting surface of the wafer; and means for applying the fluid via the passageway to and between the mounting surface of the wafer and the adherent surface with sufficient pressure to dislodge the wafer from the adherent surface.

10. Apparatus as in claim 9 wherein the adherent surface is on a wafer carrier and is provided by the surface of an at least partially compressible pad further comprising:

the passageway extending through the pad to the mounting surface of the wafer.

11. Apparatus as in claim 10 wherein the passageway further includes:

the passageway extending through the adherent surface at a location between about the center and the periphery of the mounting surface of a wafer such that the fluid is initially applied off-center of the wafer in a leveraged manner.

12. Apparatus as in claim 11 wherein the means for applying the fluid further comprises:

means for applying a liquid with sufficient pressure to dislodge the wafer but with insufficient pressure to fully disengage the wafer from the carrier such that the wafer rides upon a liquid film on the adherent surface and is readily removed therefrom.

13. Apparatus as in claim 12 wherein the means for applying the liquid further comprises:

a nozzle which penetrates through the passageway a distance sufficient to push the wafer off the liquid film; and means for extending said nozzle through the passageway and against the wafer a distance sufficient to push the wafer off the liquid film and off the carrier.

14. Apparatus as in claim 11 wherein the fluid applied via the passageway is water.

15. Apparatus as in claim 11 wherein the fluid applied via the passageway is air.

* * * * *